US006574945B2

(12) United States Patent
Martinez, Jr.

(10) Patent No.: US 6,574,945 B2
(45) Date of Patent: Jun. 10, 2003

(54) METHOD FOR MANUFACTURING A PROJECTILE CONTAINING CHEMILUMINESCENT COMPOUNDS

(75) Inventor: Raul Martinez, Jr., El Paso, TX (US)

(73) Assignee: Lumitek LLC, Del Mar, CA (US)

( * ) Notice: Subject to any disclaimer, the term of this patent is extended or adjusted under 35 U.S.C. 154(b) by 58 days.

(21) Appl. No.: 09/815,315

(22) Filed: Mar. 21, 2001

(65) Prior Publication Data

US 2002/0134055 A1 Sep. 26, 2002

(51) Int. Cl.[7] ..... B65B 3/04

(52) U.S. Cl. ..... 53/454; 53/239; 53/449; 53/474; 53/560; 206/219

(58) Field of Search ..... 53/560, 454, 474, 53/239, 449; 206/205, 207, 219; 102/223

(56) References Cited

U.S. PATENT DOCUMENTS

| | | | | | |
|---|---|---|---|---|---|
| 2,497,212 | A | * | 2/1950 | Donofrio | 156/145 |
| 2,925,719 | A | * | 2/1960 | Robbins et al. | 206/219 |
| 3,321,887 | A | * | 5/1967 | Manas | 141/64 |
| 3,353,325 | A | * | 11/1967 | Jensen et al. | 206/484 |
| 3,429,827 | A | | 2/1969 | Ruus et al. | |
| 3,539,794 | A | | 11/1970 | McKay Rauhut et al. | |
| 3,774,022 | A | | 11/1973 | Dubrow et al. | |
| 3,940,605 | A | | 2/1976 | Gerber | |
| 3,950,158 | A | * | 4/1976 | Gossett | 206/219 |
| 4,121,400 | A | * | 10/1978 | Sohn et al. | 53/239 |
| 4,375,146 | A | | 3/1983 | Chung | |
| 4,532,123 | A | | 7/1985 | Gardner | |
| 4,567,714 | A | | 2/1986 | Chasman | |
| 4,606,174 | A | * | 8/1986 | Berg | 426/410 |
| 4,631,905 | A | * | 12/1986 | Maloney | 493/196 |
| 4,640,193 | A | | 2/1987 | Koroscil | |
| 4,695,466 | A | | 9/1987 | Morishita et al. | |
| 4,706,568 | A | | 11/1987 | Lundwall et al. | |
| 4,726,171 | A | * | 2/1988 | Kreager et al. | 206/831 |
| 4,782,647 | A | * | 11/1988 | Williams et al. | 53/141 |
| 4,817,367 | A | * | 4/1989 | Ishikawa et al. | 53/454 |
| 4,894,978 | A | * | 1/1990 | Schonmann et al. | 264/4.3 |
| 4,944,521 | A | | 7/1990 | Greeno | |
| 5,018,450 | A | | 5/1991 | Smith | |
| 5,018,880 | A | | 5/1991 | Nakasugi et al. | |
| 5,171,081 | A | | 12/1992 | Pita et al. | |
| 5,254,379 | A | | 10/1993 | Kotsiopoulos et al. | |
| 5,459,983 | A | * | 10/1995 | Sadek et al. | 53/141 |
| 5,562,290 | A | | 10/1996 | Wei | |
| 5,639,526 | A | | 6/1997 | Kotsiopoulos et al. | |
| 5,640,945 | A | | 6/1997 | Slonaker et al. | |
| 5,714,186 | A | * | 2/1998 | Nash et al. | 83/347 |
| 5,740,660 | A | | 4/1998 | Rowe | |
| 5,762,058 | A | | 6/1998 | Cheng et al. | |
| 5,870,884 | A | * | 2/1999 | Pike | 156/205 |
| 6,145,441 | A | | 11/2000 | Woodall et al. | |
| 6,209,296 | B1 | * | 4/2001 | Perrone | 53/560 |
| 6,230,630 | B1 | * | 5/2001 | Gibson et al. | 102/477 |
| 6,238,616 | B1 | * | 5/2001 | Ishikawa et al. | 264/553 |
| 6,260,332 | B1 | | 7/2001 | Takayanagi | |
| 6,295,793 | B1 | * | 10/2001 | Takayanagi | 53/454 |
| 6,393,992 | B1 | * | 5/2002 | Vasel et al. | 102/367 |

* cited by examiner

*Primary Examiner*—Rinaldi I. Rada
*Assistant Examiner*—Gloria R Weeks
(74) *Attorney, Agent, or Firm*—Koppel, Jacobs, Patrick & Heybl; Michael J. Ram

(57) ABSTRACT

A number of spaced apart first and second cavities are continuously formed in first and second thin sheets of material, respectively. Each of the first and second cavities has an edge at an opening thereof. The formed first and second cavities travel in paths that are downwardly inclined from the horizontal and approach each other. A number of first bodies are fed into the first cavities, respectively, where each of the first bodies has a liquid tight interior cavity that contains a volume of a first liquid. This liquid is one that when mixed with a second liquid starts a chemiluminescent reaction. The edge of each of the first cavities is sealed progressively with the respective edge of a second cavity, while injecting the second liquid into one or both of the first and second cavities that are being sealed. This forms a liquid tight second body that contains the first body and a second volume of the second liquid.

14 Claims, 5 Drawing Sheets

PAINTBALL MANUFACTURING MACHINE

METHOD FOR MANUFACTURING A PROJECTILE CONTAINING CHEMILUMINESCENT COMPOUNDS

BACKGROUND

This invention relates generally to projectiles used for marking a target and more particularly to those that contain chemiluminescent compounds that, upon impact of the projectile with the target, create a luminescent spot on the target.

The sport of paintball has become one of the fastest growing sports in the world. The participants carry gas-charged pistols or rifles that can shoot non-lethal projectiles known as paintballs. These paintballs are hollow spheres typically made of a frangible material such as gelatin. The cavity of the sphere contains a colored liquid that is released when the sphere is crushed as the paintball impacts its target. A player loses when she has been hit, as evidenced by a spot of paint left on her body from the impacting paintball.

The sport has been traditionally a day time activity. However, there is increasing demand for night time matches. One problem with practicing paintball at night is the difficulty in seeing the spot of paint on a player that has been hit. This allows a player to "cheat" by continuing to play even when she has been hit, because the other players cannot see the spot of paint on her body. One proposed solution to this problem is the use of a luminescent paintball as described in U.S. Pat. No. 5,018,450 to Smith (the 'Smith patent'). The Smith patent describes a projectile having two separate hemispheres which are fused together to form an accurate sphere, where each hemisphere contains one of two reactive chemicals which, upon impact and destruction of the spheres, can mix to become a chemiluminescent light source. However, this proposed solution has several shortcomings.

The light output from a chemiluminescent reaction depends greatly upon the ratio of the amounts of oxalate and activator, two compounds that when mixed cause the reaction. In particular, the ratio may not be 1:1. It may be desirable to have a much larger volume of the oxalate and a small volume of highly concentrated activator, to give sufficient intensity and duration to the light output. In such a case, the two hemispheres of the paintball in the Smith patent will not be uniformly filled with the compounds as one side will be relatively empty compared to the other side. This may cause the paintball to become unstable and thereby not travel in the desired trajectory when it has been shot at high speed.

Another problem with the paintball design in the Smith patent is that filling the two hemispheres with oxalate and activator and then sealing them together, as part of a large volume manufacturing process, may be prohibitively expensive.

BRIEF DESCRIPTION OF THE DRAWINGS

The invention is illustrated by way of example and not by way of limitation in the figures of the accompanying drawings in which like references indicate similar elements. It should be noted that references to "an" embodiment in this disclosure are not necessarily to the same embodiment, and they mean at least one.

DETAILED DESCRIPTION

A projectile according to the embodiments of the invention described below has an inner body having a liquid-tight interior cavity that contains a first volume of a first liquid, and another body having a liquid-tight interior cavity that contains a second volume of a second liquid. The outer body further contains the inner body. The outer body may have a round exterior surface, such as one suitable for being shot from a paintball marker. The outer body is adapted to not rupture when the projectile has been shot at a target and to rupture only when the projectile has impacted the target. The first liquid is one that when mixed with the second liquid starts a chemiluminescent reaction that luminously marks an impact spot on the target for easy viewing at nighttime.

The use of an inner body (also referred to as a first body) within an outer body (also referred to as a second body) may help improve the trajectory of a chemiluminescent paintball. In addition, this aspect may help reduce manufacturing costs to enable large volume production of the projectiles. Such a projectile may be manufactured by, for instance, a modified, conventional paintball manufacturing machine. A number of smaller, inner bodies (filled with the first liquid) are formed first, and then the these may be placed into one or both halves of the larger, outer bodies, while simultaneously filling the two halves of the outer bodies with the second liquid and sealing the two halves against each other.

Figures 1A, 1B, 1C:
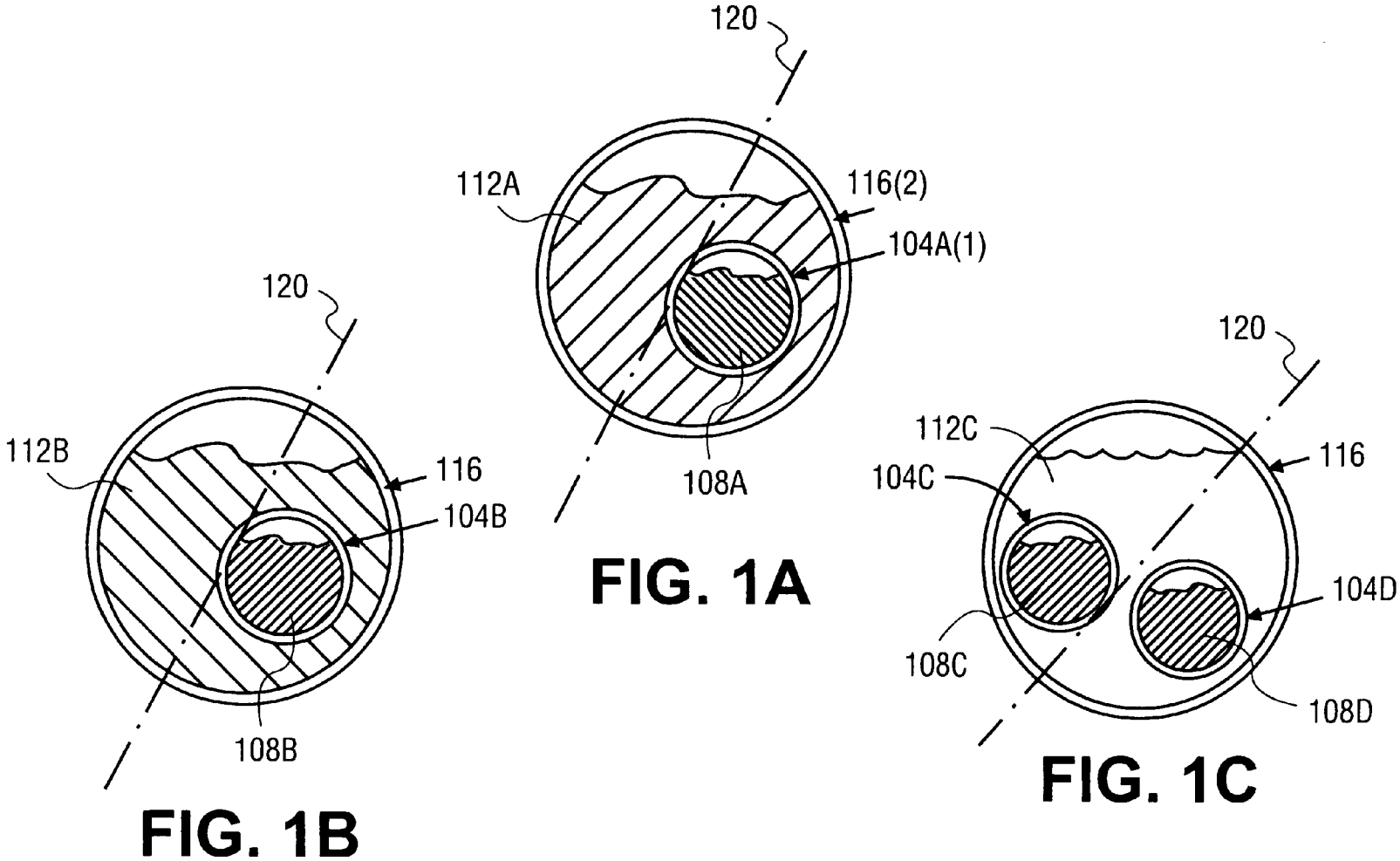
FIGS. 1A, 1B, and 1C depict a projectile according to some embodiments of the invention.

FIGS. 1A through 1C depict a projectile according to some embodiments of the invention. In each of these figures, the projectile has a first body 104 in which a liquid tight interior cavity contains a first volume of a first liquid 108. This first liquid is one that when mixed with a second liquid 112 starts a chemiluminescent reaction. A second volume of the second liquid 112 is contained in the liquid tight interior cavity of a second body 116. As can be seen, the first body 104 is also contained within the liquid tight interior cavity of the second body 116. To make the projectile compatible with existing paintball markers, the second body 116 may have a round exterior surface. The round surface may be entirely smooth, dimpled, or otherwise configured to help fulfill the requirements of holding its trajectory after being shot at a target from the marker. In one embodiment, both bodies are adapted to not rupture when the projectile has been shot at a target, and to rupture only when the projectile has impacted the target. In another embodiment, only the inner body is relatively fragile and is designed to rupture when the projectile has been shot, so as to allow mixing of the liquids inside the second body 116 while the projectile is in flight.

In each of the FIGS. 1A through 1C, a center line 120 is drawn bisecting the sphere which represents the second body 116. The three different projectiles differ in the size and number of first bodies 104 that are contained within the second body 116. In FIG. 1A, the first body has a diameter that is no larger than one-half the inner diameter of the second body 116. In contrast, in FIG. 1B, the first body 104 has a diameter that is larger than one-half the inner diameter of the second body 116. In FIG. 1C, there are two first bodies 104*a* and 104*b* each of which has a diameter that is slightly smaller than one-half the inner diameter of the enclosing second body 116. The choice of using one or multiple first bodies 104 may be made based upon manufacturing cost considerations as well as the effect on the trajectory of the projectile. Another factor that may influence the size and number of first bodies 104 is the ratio of the first and second volumes of the first and second liquids, respectively, that will be needed to provide the desired chemiluminescent reaction. Also, it may be expected that the size of the inner bodies should be no less than 30% of the inner diameter of the outer body to ensure that the inner bodies rupture either upon the projectile being shot or upon impact with the target, so that the two liquids will sufficiently mix and luminously mark the target.

In one embodiment, the first and second liquids are an oxalate and an activator. More particularly, the first liquid 108 could be the oxalate of which a smaller volume is needed than the activator. An example of the oxalate is the material known in the chemiluminescent industry as cylume which may be a mixture of 10–20% bis (2,4,5 trichloro-6-carbopentory phenyl) oxalate and 80–90% of a suitable solvent. The activator may be, for instance, a mixture of 85–90% dimethylphthalate, 10–15% t-butyl alcohol, and 2–5% hydrogen peroxide. Activators and oxalates having other mixtures and ingredients may alternatively be used if they can provide a sufficiently luminous impact spot on the target upon being released from the ruptured projectile, for the period of time that it would take a participant in a night time paintball match to identify another who has been hit. The formulation of the oxalate and activator may, as a further alternative, be designed to suit applications other than a paintball match. In a further embodiment, one or both of the first and second liquids further includes a color material, to mark with color the impact spot on the target. For instance, the oxalate (rather than the activator) may include the color material.

As mentioned above, the second body 116 is designed to rupture but only upon impact with the target and not when the projectile has been shot, to release the liquids. In addition, both bodies are made of a material and have a design such that when the projectile is being normally handled prior to being shot, neither body will rupture, thereby continuing to keep the first and second liquids separate from each other. The first body 104 should be of a material and of such a design that it should rupture either upon being shot or upon the projectile impacting the target (depending on the embodiment), so as to release the first volume of the first liquid 108 and allow mixing with the second liquid 112 to start the chemiluminescent reaction. The material also does not dissolve when in contact with the oxalate and does not adversely affect the mixing and light output of the liquids. An example of a material that is suitable for making both the first and second bodies is gelatin. This is a material which is well understood and used for manufacturing single-body, conventional paintballs. As an alternative to using the same material (such as gelatin) for both first and second bodies, the first body 104 may be made of a different material than the second body 116 for reasons such as reduced manufacturing costs and/or early mixing of the two liquids prior to impact.

Although FIGS. 1A through 1C show the interior cavity of the second body 116 as being round, other shapes may be provided if more suitable to accomplish one or more of the above mentioned goals of the second body 116. Similarly, the first body 104 although shown as having a round exterior surface may alternatively be configured with a different shape if it would assist in lowering manufacturing costs, improving the predictability or accuracy of the trajectory of the projectile, and/or mixing and release of the two liquids either upon being shot or at impact.

Figure 2:
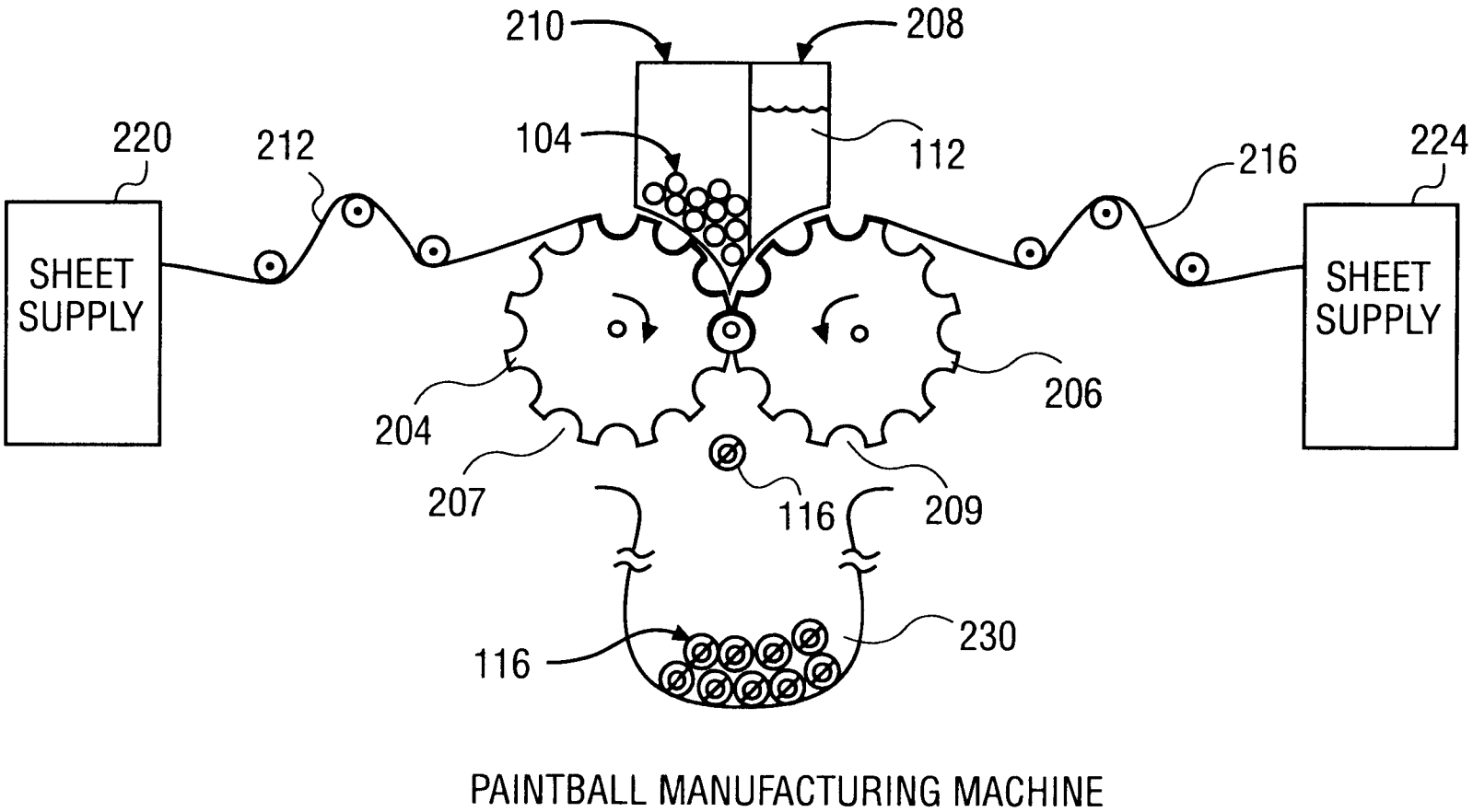
FIG. 2 shows a machine, according to an embodiment of the invention, for manufacturing the projectile.

Referring now to FIG. 2, a block diagram of a portion of a machine for manufacturing the projectile is shown. This machine is an example of a modified, conventional encapsulation machine that may be used for the automated manufacturing conventional paintballs. The machine has two cylindrical die rolls 204 and 206 which are automatically controlled and driven in opposite directions and are positioned adjacent to each other as shown. A container 208 and a hopper 210 are positioned above the die rolls. The lower ends of the hopper and the container are wedge shaped and are placed in close proximity to the die rolls 204 and 206. The hopper 210 holds a number of first bodies 104, whereas the container 208 holds a volume of the second liquid 112.

Each die roll 204, 206 has a number of cavities 207, 206 formed on a cylindrical surface thereof, designed to pull respective first and second thin flexible sheets 212 and 216 as it is being rotated. One end of the sheet 212 is positioned against the cylindrical surface of the die roll 204 such that the sheet 212 takes the shape of the cavities 207 in the die roll. This may be done by for instance applying a vacuum at each cavity 207 of the die roll to pull a portion of the sheet 212 into the cavity 207, thereby forming a corresponding cavity in the sheet. The sheets are pulled from respective sheet supplies 220 and 224 through a system of pulleys that provide some accumulation of the thin sheet and/or control the tension between the sheet supply and the die roll. A container 230 holds the second bodies 116 after they have been formed and removed from the die rolls as the die rolls are rotated. A detail view of the machine showing the formation of the second bodies 116 and their removal from the cavities in the die rolls is shown in FIG. 3.

Figure 3:
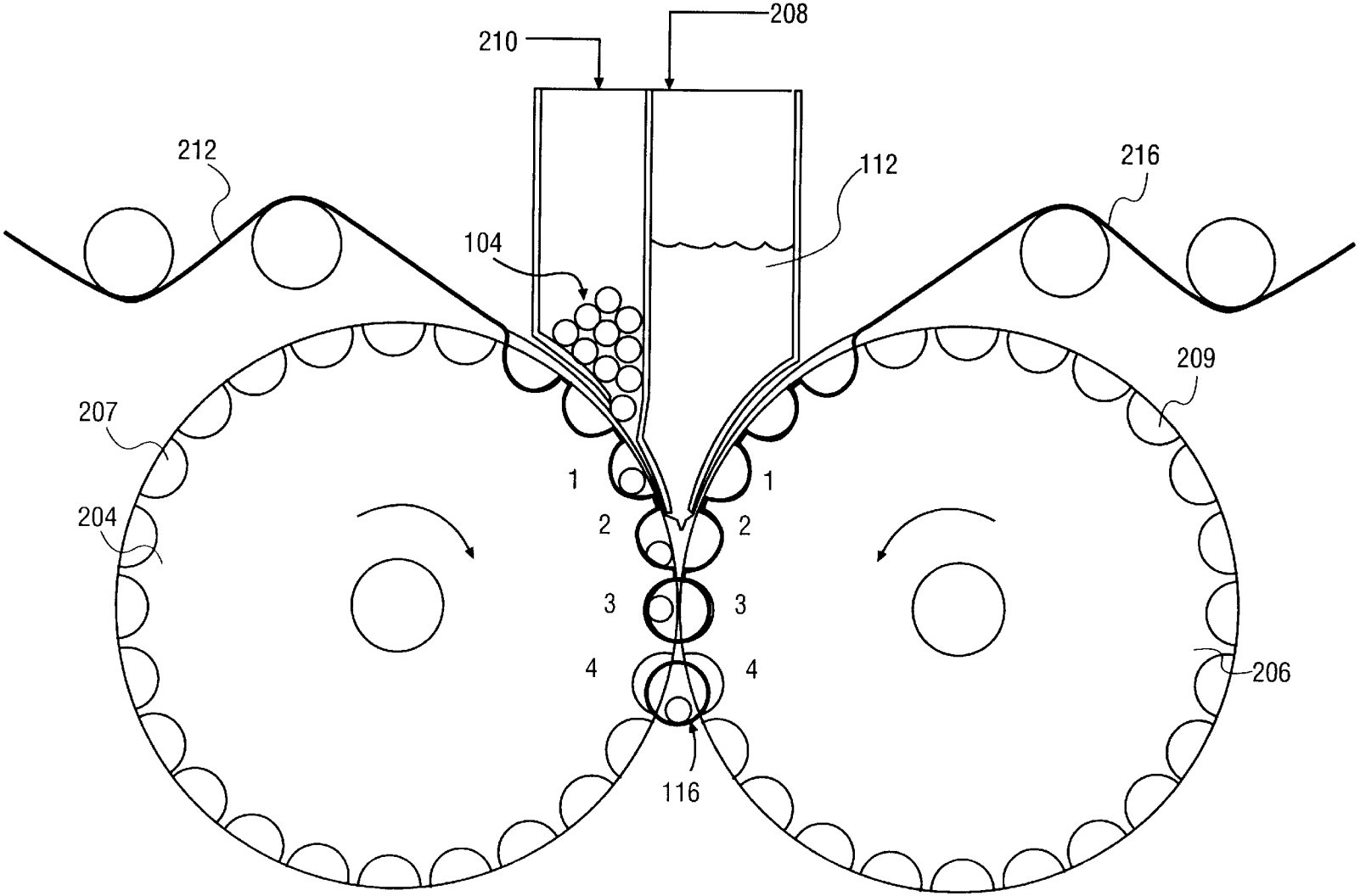
FIG. 3 illustrates a detail view of the die rolls in the machine.

FIG. 3 shows a zoomed in side view of the machine of FIG. 2, in which the die rolls 204 and 206 are shown, with corresponding cavities 207 and 209, as they rotate through positions 1–4 in the directions indicated by the arrows. As the die rolls rotate, a number of spaced apart cavities are continuously formed in the first thin sheet 212 and the second thin sheet 216, corresponding to the shape of the cavities 207 and 209. The lower ends of the hopper 210 and container 208 are wedge shaped and sized such that after a first body 104 has been moved from the hopper into a cavity formed in the first sheet 212, this first body 104 will not be able to fall out of its cavity and will remain in there until the die roll 204 has rotated to position 4 and beyond, at which time the two corresponding cavities 207 and 209 will move away from each other and release the second body 116. Returning to position 1, as the die rolls rotate, the cavities are brought sufficiently close to each other so that the edge of each of the cavities formed in the sheets 212 and 216 is progressively sealed to the other, starting at position 3, while the second liquid 112 is injected into one or both of these cavities that are being sealed. The second liquid 112 is injected through a port mechanism 420 seen in greater detail in FIG. 4. In this figure, it can be seen that after a first body 104 has been placed into a cavity at position 1, through a port 424, the second liquid 112 is forced into this cavity and a corresponding one in die roll 206 when the die rolls have rotated to position 2. At this position, the port mechanism 420 is in liquid communication with a pair of cavities. As the die rolls reach position 3, the edges of each of the cavities are brought next to each other and may be progressively sealed as the dies continue to rotate beyond position 3. The die rolls should rotate fast enough so that the first and second liquids are not exposed to the air for too long, as this might degrade the performance of the subsequent chemiluminescent reaction; the liquids should be forced into the cavities and thereafter quickly sealed.

Referring now back to FIG. 3, when the die rolls have reached position 4, the formed second body 116 (with both halves joined) is now ready to be released from the cavities in the die rolls 204 and 206. Depending upon the particular machine, there may be a brief period of drying to which the freshly formed second body 116 is subjected prior to being placed on the stack of second bodies 116 within the container 230 (see FIG. 2).

In another embodiment, the first sheet 212 has a sticky surface such that it can lightly attach to and pull a first body 104 that is exposed at an opening of the port mechanism 424. A vacuum is then applied to the underside of the first sheet 212, which results in the attached first body 104 being pulled downwards simultaneously with the cavity being formed in the first sheet 212.

Figure 4:
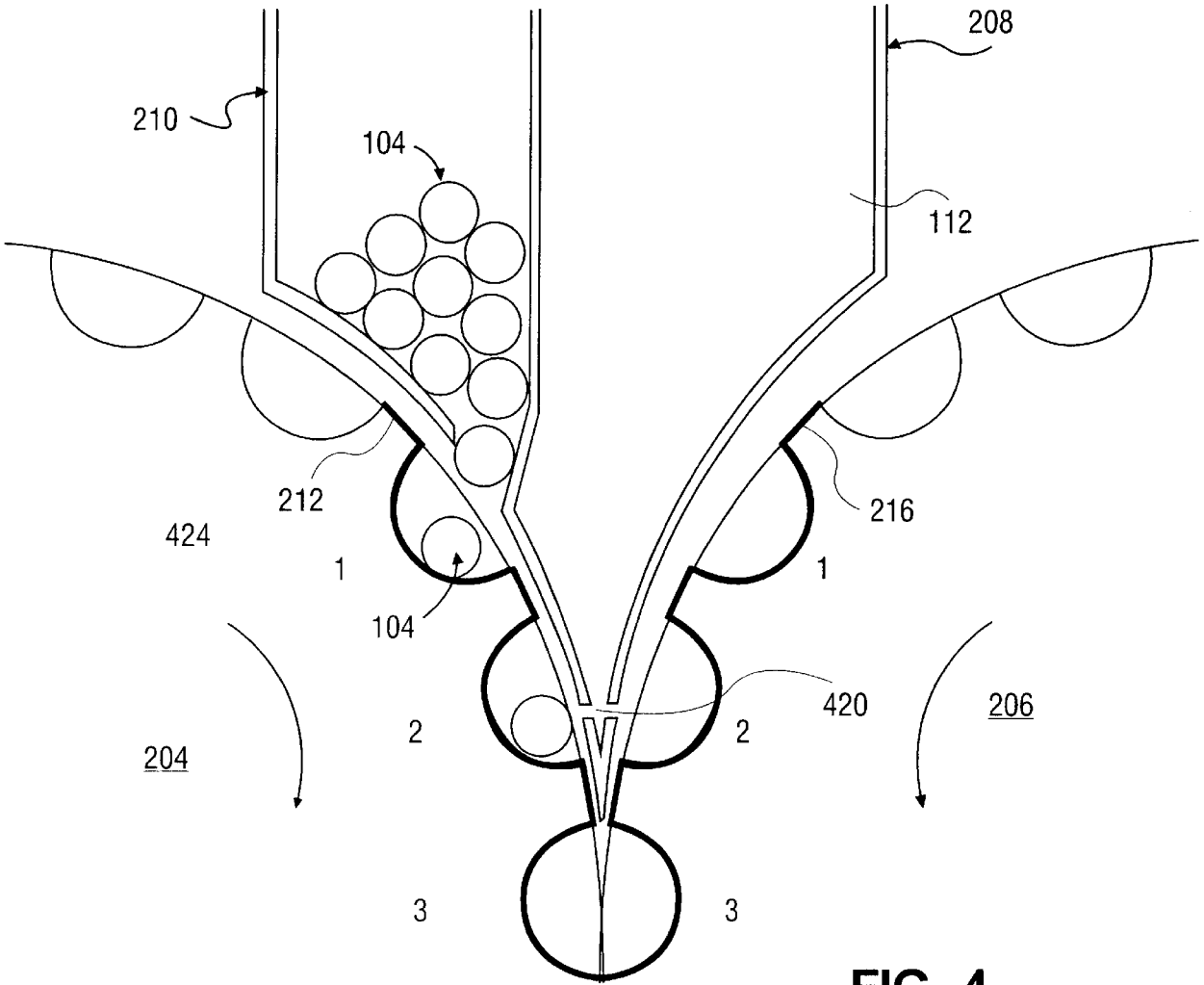
FIG. 4 depicts greater detail of the die rolls as a projectile is about to be formed.

One of ordinary skill in the art will recognize that the machine used for manufacturing the projectile in FIGS. 2–4 may be a modified version of a conventional paintball manufacturing or encapsulation machine, where the modification includes the provision of a suitably sized and positioned hopper 210 for holding a number of first bodies 104 and for placing the bodies into respective cavities that have been formed in the first thin sheet 212 and a container 208 for holding a volume of the second liquid 112 (be it an oxalate or an activator). Factors such as the thickness of the sheets and the moisture content therein determine the brittleness or softness of the projectile and should be selected such that the second body 116 ruptures upon impact with the target, but not upon being shot.

Although the embodiment of the machine shown in FIGS. 2–4 shows a single first body 104 being placed within one half of a second body 116, the machine may be further modified to permit a second, first body 104 to be placed into the other half of the second body 116, such that two first bodies 104 are contained within the second body 116 (see FIG. 1C).

Figure 5:
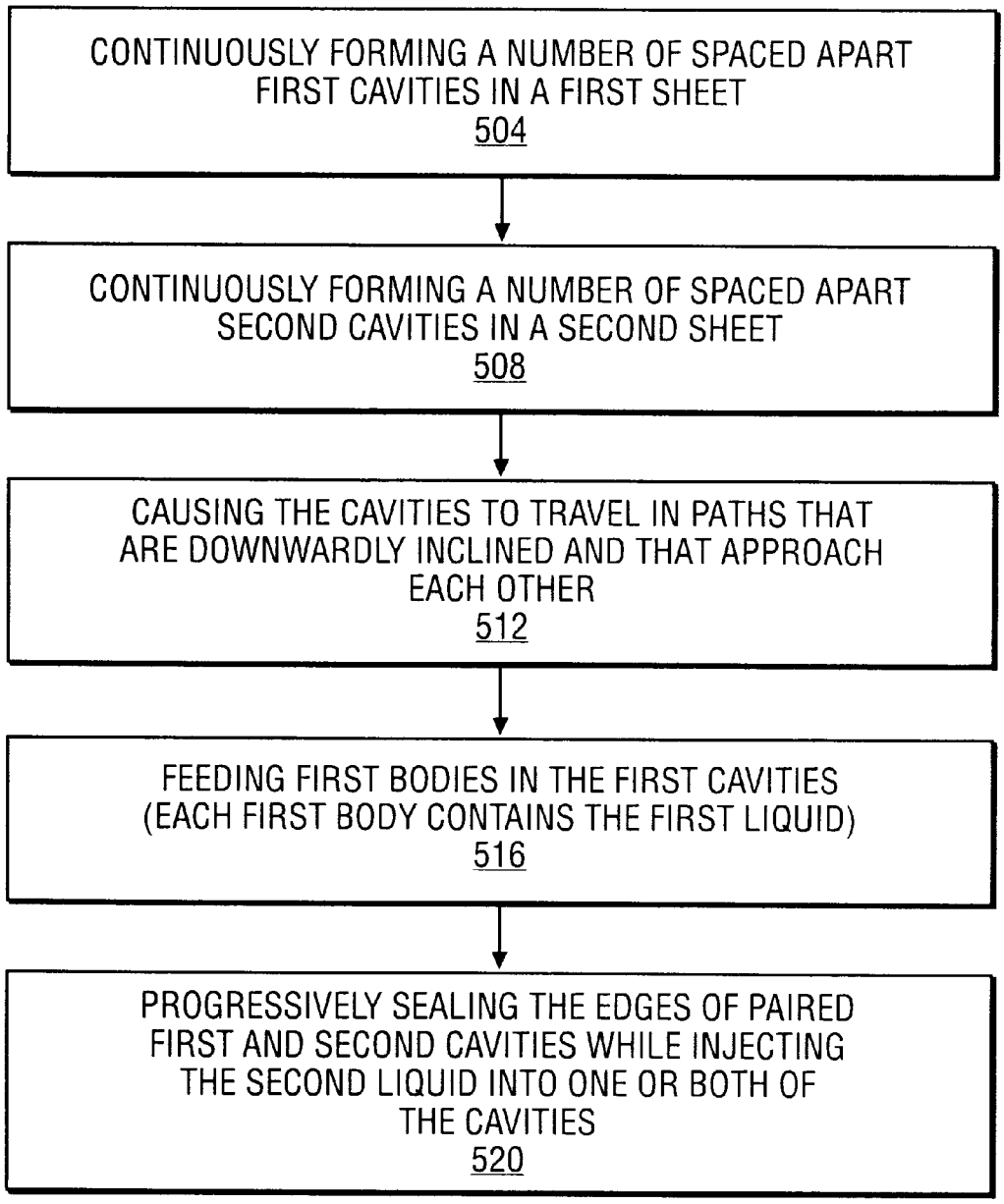
FIG. 5 shows an exemplary flow diagram of process operations performed in manufacturing the projectile.

Referring now to FIG. 5, what's shown is an exemplary flow diagram of process operations performed in manufacturing the projectile. The process involves the continuous formation of a number of spaced apart first cavities in a first sheet of material, from a supply of a material (block 504). Each of the first cavities has an edge at an opening thereof. A number of spaced apart second cavities are continuously formed in a second thin sheet of material from a supply of the material (block 508). Again, each of the second cavities has an edge at an opening thereof. The first and second cavities are caused to travel in paths that are downwardly inclined from the horizontal and that approach each other (block 512) such as shown in FIGS. 2–4. A number of first bodies are fed into the first cavities, one body to each cavity (block 516), and then progressively sealing the edges of paired cavities while injecting the second liquid 112 into one or both of the cavities being sealed (block 520), to form a liquid-tight second body 116 that contains both the first body and a second volume of the second liquid 112. As mentioned above, substantially the same procedure for forming the second body may be used to form a number of the first bodies 104.

To summarize, embodiments of a projectile containing chemiluminescent compounds for marking a target, as well as techniques for manufacturing such a projectile, have been described. In the foregoing specification, the invention has been described with reference to specific exemplary embodiments thereof. It will, however, be evident that various modifications and changes may be made thereto without departing from the broader spirit and scope of the invention as set forth in the appended claims. For instance, the encapsulation process using the thin sheets may be gelatin based (using, e.g. bone gelatin or blood gelatin), but alternatively may be a non-gelatin process that uses a vegetable oil, starch or a gum material or the gelatin-free XGel™ Film System by BioProgress Technologies of Atlanta, Ga. The specification and drawings are, accordingly, to be regarded in an illustrative rather than a restrictive sense.

What is claimed is:

1. The method for manufacturing a plurality of projectiles, each projectile having a discrete enclosed body therein, comprising:

a) continuously feeding a first thin sheet of material onto a first rotating die and a second thin sheet of material onto a second rotating die, b) continuously forming a plurality of spaced apart first cavities in a first thin sheet of material each of the first cavities having an edge at an opening thereof;

c) continuously forming a plurality of spaced apart second cavities in a second thin sheet of material, each of the second cavities having an edge at an opening thereof;

d) causing the first and second sheets with first and second cavities to travel in paths that are downwardly inclined from the horizontal and that approach each other;

e) feeding at least one enclosed body into each of the first cavities, respectively, each of the enclosed bodies having a liquid-tight interior cavity containing a quantity of a first liquid, and f) progressively sealing the edge of each of the first cavities with the edge of a respective second cavity while injecting a second liquid into one or both of the first and second cavities prior to sealing the edges thereof forming a liquid tight projectile containing the enclosed body within a volume of the second liquid, the first liquid and the second liquid, when mixed, initiating a chemiluminescent reaction.

2. The method of claim 1 wherein the first and second liquids are an oxalate and an activator.

3. The method of claim 2 wherein the first liquid is the oxalate and the second liquid is the activator.

4. The method of claim 1 wherein the first and second thin sheets of material are made of gelatin.

5. The method of claim 1 wherein the projectile and enclosed body are round and the first body has a diameter that is no greater than about one-half an interior diameter of the projectile and no less than about 30% of the interior diameter of the projectile.

6. The method of claim 1 wherein the first or second liquid further includes a color material.

7. A method of forming a rupturable projectile containing at least one breakable body and at least a first and a second reactive component, the first of said reactive components being enclosed in the breakable body, the second reactive component enclosed in the rupturable projectile exterior of the breakable body, comprising a) providing a first and a second die, each die having a plurality of spaced apart cavities in a surface thereof, b) continuously feeding a first thin film to the first die surface and a second thin film to the second die surface, the first and second thin film being caused to conform respectively to the plurality of cavities in the first and second die, continuously forming a plurality of first corresponding cavities in the first film and second corresponding cavities in the second film, an edge being formed around each cavity in each film, the first and second film being feed towards each other in paths downwardly inclined from the horizontal, c) placing at least one breakable body in one of the first cavities and a quantity of second reactive component in said first cavity or second corresponding cavity or both first and second corresponding cavities, and d) sealing the edge of the first cavity in the first film to the edge of the corresponding second cavity to form the rupturable projectile containing the breakable body with the first reactive component therein and the second reactive component exterior to the breakable body, e) continuously performing the above steps to subsequently produce corresponding cavities in the first and second film and converting said corresponding cavities to rupturable projectiles.

8. The method of claim 7 wherein the first and second reactive components comprise an oxalate and an activator, the breakable body being composed of a material not dissolved by the oxalate.

9. The method of claim 8 wherein the first reactive component comprise an oxalate.

10. The method of claim 9 wherein the volume of the oxalate is less than the volume of the activator.

11. The method of claim 7 wherein the rupturable projectile and the breakable body are each comprised of materials that ruptures only on impact with a target.

12. The method of claim 11 wherein the rupturable projectile and the breakable body are each formed from the same material.

13. The method of claim 7 wherein the rupturable projectile is comprised of a material that ruptures only on impact with a target and the breakable body projectile is comprised of a material that ruptures on shooting the projectile from a delivery device.

14. The method of claim 7 wherein the rupturable projectile and the breakable body are each comprised of frangible gelatin.

* * * * *